US005347288A

United States Patent [19]

Page

[11] Patent Number: 5,347,288

[45] Date of Patent: Sep. 13, 1994

[54] OPTICAL COMMUTATOR

[75] Inventor: Derrick J. Page, Crownsville, Md.

[73] Assignee: Westinghouse Electric Corporation, Pittsburgh, Pa.

[21] Appl. No.: 67,191

[22] Filed: May 26, 1993

[51] Int. Cl.[5] ..... H01Q 3/02

[52] U.S. Cl. ..... 342/375; 342/374

[58] Field of Search ..... 342/374, 375; 359/128, 359/134

[56] References Cited

U.S. PATENT DOCUMENTS

| | | | |
|---|---|---|---|
| 4,028,702 | 6/1977 | Levine | 342/374 |
| 4,229,746 | 10/1980 | Charlton | 342/374 |
| 4,529,986 | 7/1985 | d'Auria et al. | 342/374 |
| 4,620,193 | 10/1986 | Heeks . | |
| 4,725,844 | 2/1988 | Goodwin et al. | 342/374 |
| 4,814,773 | 3/1989 | Wechsberg et al. . | |
| 4,954,834 | 9/1990 | Buck | 342/360 |

*Primary Examiner*—Mark Hellner

[57] ABSTRACT

A device for delaying signals fed to radiating elements of an array antenna by providing delay paths of selective lengths between respective antenna elements and a signal input source. A plurality of first optical fibers are provided, each having a selected length. A plurality of second optical fibers are also provided, each having a selected length. The first output fibers are alignable to the second fibers to form respective delay paths. At least one of the set of first fibers and set of second fibers is movable relative to the other so that when moved, selected first fibers are aligned with selected second fibers creating a particular delay path of a selected length from the input source to each radiating element.

20 Claims, 7 Drawing Sheets

OPTICAL COMMUTATOR

BACKGROUND OF THE INVENTION

1. Field of the Invention

This invention relates to array antennas and is particularly concerned with providing time delay steering to array antenna elements.

2. Description of the Prior Art

An array antenna consists of a group of antenna elements spaced apart usually at regular intervals to form an array. By either controlling the relative timing or the phasing of the common signal at the transmitting elements, a beam is propagated that can be steered in space.

The most common means of steering a beam in an antenna array is to control the relative phase of the signal at the elements. For the case of a flat antenna array, if all the elements are operated in unison, the beam will be pointed in the boresight direction, which is the direction perpendicular to the plane of the array. If a linearly increasing phase shift is introduced across the face of the array, the beam will be deflected at some angle from the boresight direction, and the larger the phase shift, the larger will be the angle between the beam direction and the boresight direction. Such antenna systems, referred to as phase arrays, are employed in applications where it is required to steer the beam rapidly in space.

Controlling the relative phase of each of the antenna elements requires that each element contain a phase shifting device and that an electronic control system be used to control the phase of each of the elements. However, the wide scale use of phased arrays has been limited by the high cost of their complex circuitry. Furthermore, if the phase shifting circuit is adjusted to steer in a particular direction, this setting will only be valid for a particular frequency. Therefore, known phase shifting techniques impose a limit on the frequency range of operation.

Another technique that is used to steer the beam in an array antenna is to control the relative timing of the transmitted signal at the radar elements. If the signal at each of the radiating elements is emitted in unison, a wave front is formed that is parallel to the plane of the array. The signal beam is directed perpendicular to the wave front, therefore, when the signal is emitted from the antenna elements in unison, the beam is directed perpendicular to the plane of the array (the boresight direction). When the emission from the antenna elements is not in unison, but is varied in time along the array, the angle of the wave front relative to the plane of the array will change and the beam will be steered away from boresight. If, for example, the signal emission from any element to its nearest adjacent element is delayed a time t and each element is spaced a distance d apart, the steered angle $\Phi$ between the boresight direction and the beam direction is given by the formula $\sin \Phi = t\,c/d$, where c represents the velocity of light. True time delay techniques allow antenna arrays to operate over extremely wide frequency ranges as the delay techniques are frequency independent.

The use of fiber optics in communication systems is known. The optical fiber is usually used to connect two distant points so that communications can be conducted. A commercially available laser unit is used to generate an optical signal. The optical signal travels through the optical fiber to where it is converted to a microwave signal by an optical detector and a microwave amplifier, which are commercially available. Fiber optic media offer the advantage of exceptional bandwidth as compared with other traditional transmission means such as copper wire.

Optical techniques have been suggested to control array elements. Schemes have been proposed to use a selection of optical fibers with lengths arranged in a binary or quadratic sequence and to switch in a series string combination to achieve a desired timing. This would result in a very complex control scheme employing thousands of optical fibers and optical switches for even the simplest phased array.

SUMMARY OF THE INVENTION

I provide a device that performs the timing function for an antenna array. The timing scheme for a particular array antenna design is "hard-wired" by having a series of optical fiber delay lines built-in to a movable element. The optical fiber delay lines of the movable element are of selected lengths and have first ends which are alignable to an optical source. A second end of the movable element fibers are alignable to respective output optical fibers. The output fibers are also of selected lengths and transfer the optical signals to respective means for converting the optical signals to RF signals. Each RF signal is then carried to a respective radiating element.

The movable element may be any element that moves relative to the output fibers such as a carriage that moves linearly relative to the output fibers, but the preferred moving element is a cylindrical rotor which may be rotated. As the rotating element rotates, the parallel optical signal is transmitted through selected optical delay line paths to each radiating element, imparting a selected time delay upon the transmitted signal at each radiating element. By controlling the amount of time delay at each radiating element, a wavefront may be created such that the antenna beam is directed perpendicular to the wavefront.

In a first preferred embodiment, the hard-wired optical delay lines are built into a device that resembles an electric motor. In this embodiment, a rotor is provided having an inner cylindrical surface and a coaxial outer cylindrical surface. The rotor inner surface borders and defines a cylindrical cavity. The optical fibers are disposed within the rotor and each have a first end that terminates at the center of the rotor cavity. The rotor optical fibers further have a second end that terminates along the periphery of the rotor outer surface. The rotor fiber second ends are circumferentially spaced on the outer surface periphery.

A stator is also provided. The stator has a cylindrical cavity disposed therethrough defined by a cylindrical surface of the stator that borders the stator cavity. The rotor is disposed coaxially within the stator cavity. A plurality of output optical fibers are disposed within the stator. A first end of each output optical fiber is alignable with the second end of the selected rotor fibers. A second end of the output optical fibers are connectable by way of optical detectors to respective radiating elements. Being configured as a rotor and a stator, the device may also operate as a conventional electric motor by providing a set of integrated electrical windings. Alternatively, the rotor may be mounted on a shaft or otherwise caused to rotate through an independent motor. The input source, which is preferably a commercially available laser, will be positioned so as to direct the optical input toward the center of the rotor cavity, transmitting the optical signal into the rotor fiber first ends.

A second preferred embodiment also involves a generally cylindrical rotor. A plurality of optical fibers are provided within the rotor, with both the first and second ends of the fibers terminating along the periphery of the rotor such that the fiber ends are circumferentially spaced on the rotor periphery. As with the embodiment above, the optical fibers in the rotor each have selected lengths. An input source located at the outer periphery of the rotor provides an optical input to the first end of selected rotor fibers. A plurality of output optical fibers each of a selected length are also provided. A first end of each output fiber is alignable with the second end of the selected rotor fibers. A second end of the output fibers are connectable to respective radiating elements. An aligned output fiber and rotor fiber comprise a respective delay path to an antenna element.

The output fiber optics may be placed in a housing that is independent from the input source. Alternatively, both the input source and the output optical fibers may be housed in a stator that is coaxial to and surrounds the rotor. In any event, a means is provided for rotating the rotor. The rotor can be rotated so that different combinations of rotor fibers can be aligned with the output fibers.

A set of optical fibers may be provided intermediate to the input source and the rotor fibers. In this case, the delay path would be comprised of the aligned output fiber, rotor fiber and the intermediate fiber. Thus, the lengths of the rotor fibers as well as the lengths of at least one of the set of intermediate fibers and the set of output fibers may be varied to provide the selectable delay paths.

By providing a signal to each element through paths that are selectable in length, the time in which it takes the signal to arrive at the radiating element may be controlled. With the timing to each element controllable, a wavefront may be generated from the antenna array and thus the beam may be propagated in a direction perpendicular to the wave front.

Two dimensional steering can be accomplished by employing two optical commutators in series, one provides the elevation and the other the bearing steering. The first commutator provides a selected number of outputs which feed a second commutator in which each of the outputs from the first commutator are in turn divided into a selected number of outputs so as to provide the delays necessary to steer a full array.

The optical commutator may be employed in a number of antenna array configurations. For example, the radiating elements may be arranged in a linear array, in a circular array or in a conformal array. Additionally, it may be useful to employ more than one set of rotor fibers so that different groupings of radiating elements are connectable to different time delay paths.

Other objects and advantages of the invention will become apparent from a description of certain present preferred embodiments thereof shown in the drawings.

DETAILED DESCRIPTION OF THE PREFERRED EMBODIMENT

Figure 1A:
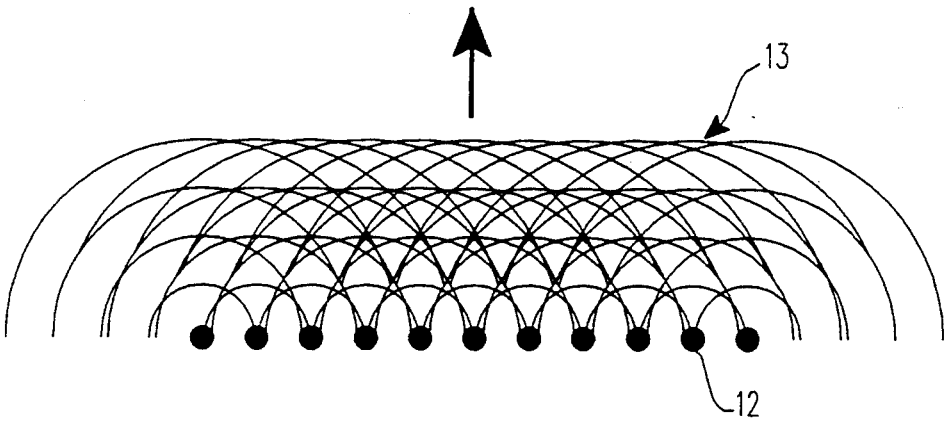
FIG. 1A is a schematic representation of the antenna elements of an array antenna transmitting in unison.
Figure 1B:
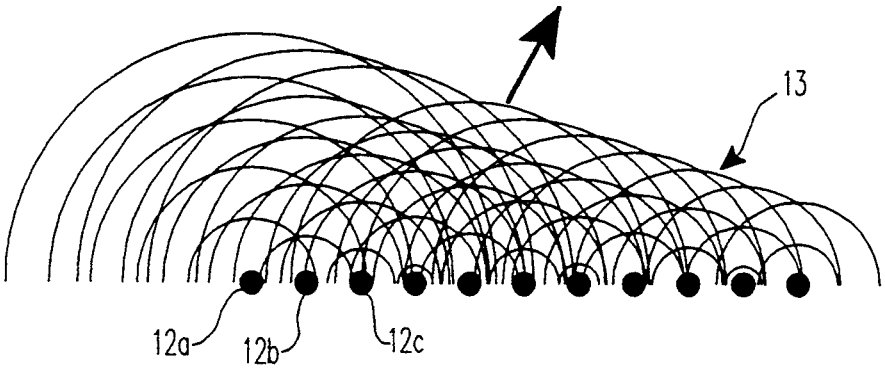
FIG. 1B is a schematic representation of the antenna elements of an array antenna transmitting with time delay.

Referring first to FIGS. 1A and 1B, a series of radiating elements 12 are shown projecting respective signals. In FIG. 1A, the signal at each of the radiating elements 12 is emitted in unison to form a wavefront 13 that is parallel to the plane in which the radiating elements 12 reside. A signal beam (which is essentially a vector representing the direction of the most intense radiation, designated as an arrow in FIGS. 1A and 1B) is directed perpendicular to the wavefront 13. Therefore, when the signal is emitted from the radiating elements 12 in unison, the beam is directed in the boresight direction.

Referring next to FIG. 1B, when the emissions from the antenna elements 12 are not in unison but are varied in time along the array, the wavefront 13 lies in a plane that is at an angle to the plane in which the radiating elements 12 reside. The beam is directed perpendicular to the wavefront 13, therefore, the beam in FIG. 1B is directed at some angle from boresight. Thus, by controlling the amount of time delay at each element 12, the array antenna beam may be steered. For example, if the end element **12*a* is taken as a reference to steer a beam to the right, the element 12*b* next to the end element 12*a* will have to be delayed by a time t and the next adjacent element 12*c* to be delayed by a time 2t (or $t_2$ if the elements are not equally spaced) and so on. To steer the beam to the left, the element 12*b* next to the end element 12*a* should be advanced by a time t and the element 12*c* next to that by a time 2t (or $t_2$) and so on. Larger steering angles require larger values of t. According to this invention, I prefer to effectuate the time delay at each element 12 by introducing a single optic signal through a number of fiber optic transmission paths 32 in which the lengths of the paths 32** are varied according to the beam direction desired. The fiber optics may be fabricated of either glass or plastic. Glass may be used when higher precision is required, whereas plastic is a relatively inexpensive alternative when less precision is required.

Figure 2:
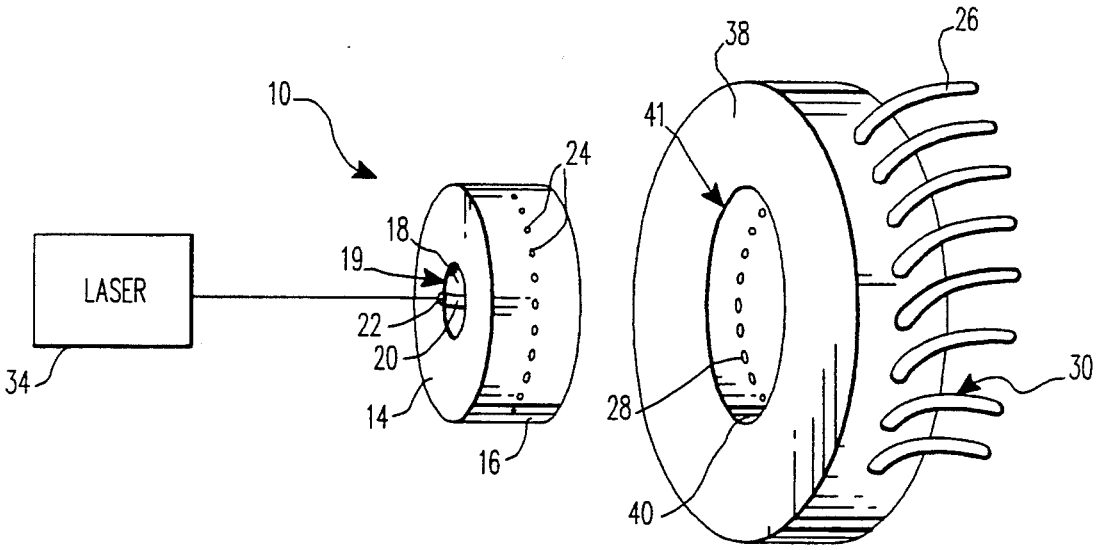
FIG. 2 is an exploded perspective view of a first preferred optical commutator.

Referring next to FIG. 2, a first preferred embodiment of an optical commutator 10 is shown. A movable element, preferably a rotor 14, is provided that is rotatable about a center axis. The rotor 14 has a cylindrical inner surface 18 and a coaxial cylindrical outer surface 16. The rotor inner surface 18 borders and defines a cylindrical cavity 19. A plurality of optical fibers 20 are disposed within the rotor 14 with a portion of each rotor fiber 20 extending partially out of the rotor inner surface 18. Although the movable element is preferably a rotor 14, it is understood that the set of optical fibers 20 housed in the rotor 14 may be housed in any movable element such as a carriage that moves linearly.

Each rotor fiber 20 has a first end 22 and a second end 24. Each rotor fiber first end 22 extends out of the rotor inner surface 18, and terminates at an area located near the center of the rotor cavity 19. Each of the rotor fiber first ends 22 are directed in the same direction relative to one another. The rotor fiber first ends 22 are preferably directed in a direction parallel to the axis of rotation of the rotor 14. As an alternative of this embodiment, the rotor need not have a rotor cavity 14, but may be cylindrically shaped. In this alternative, the rotor fiber first ends 22 would extend out of the area of the rotor near its center in a direction parallel to the axis of rotation of the rotor 14.

An input source 34, which is preferably a laser is positioned so as to direct the optical input towards the center of the rotor cavity 19, transmitting the optical signal into the rotor fiber first ends 22. Devices capable of providing high intensity, amplitude modulated optical energy are required to deliver the optical signal to the optical commutator. Laser diodes are preferred because such units are available with relatively fast rise and fall times and are also capable of operation up to many GHz.

Each rotor fiber second end 24 terminates along the periphery of the rotor outer surface 16. The rotor fiber second ends 24 are spaced apart circumferentially on the outer surface 16, preferably by a constant distance. Each rotor fiber 20 has a selected length so that the set of rotor fibers collectively have a selected distribution of lengths. The length distribution of the rotor fibers 20 is based upon the configuration of the radiating elements. Mathematical algorithms may be employed to assist in arriving at the fiber length distribution.

The first preferred optical commutator further has a stator 38 that has a cylindrical cavity 41 disposed centrally therethrough. The stator 38 has a plurality of output optical fibers 26 disposed therein. Each output fiber 26 has a selected length so that the set of output fibers collectively have a selected distribution of lengths. The length distribution of the output fibers is based upon the configuration of the radiating elements. Mathematical algorithms may be employed to assist in arriving at the fiber length distribution. The output fibers 20 further have a first end 28 and a second end 30. The first end 28 of each output fiber 26 terminates along the periphery of the stator inner surface 40 so as to be circumferentially spaced. The output fiber first ends 28 are thus alignable with the second end 24 of the rotor fibers 20.

Figure 3A:
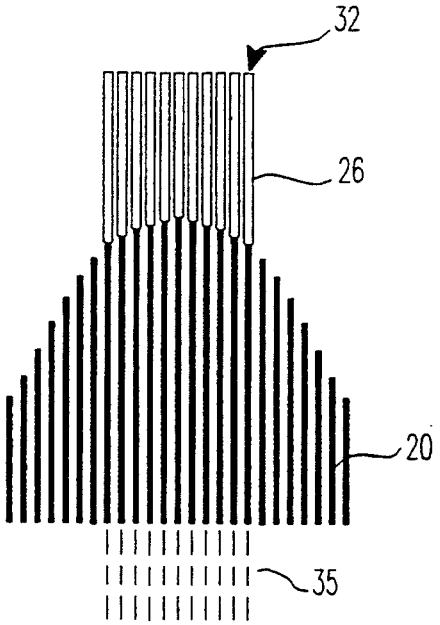
FIG. 3A is a representation of the alignment of the rotor fibers and the output fibers at the boresight setting for a linear antenna array.
Figure 3B:
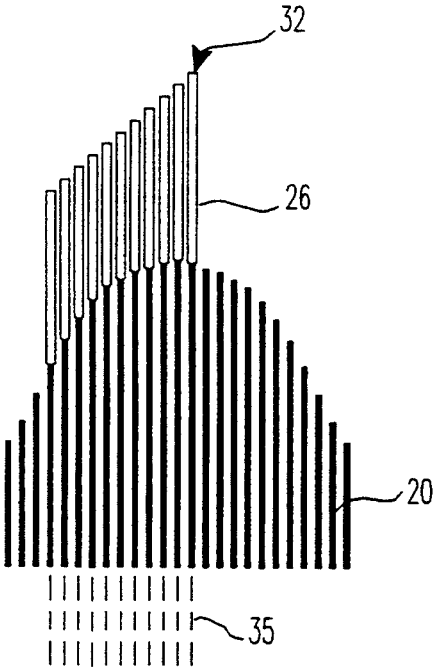
FIG. 3B is a representation of the alignment of the rotor fibers and the output fibers in a steer right setting for a linear antenna array.
Figure 3C:
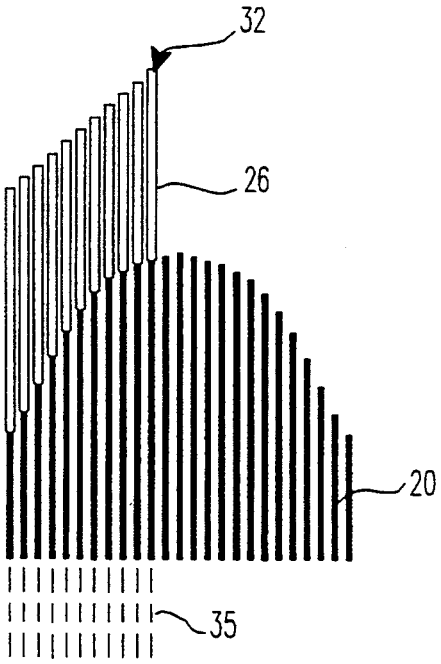
FIG. 3C is a representation of the alignment of the rotor fibers and the output fibers in a steer far right setting for a linear antenna array.

Referring next to FIGS. 2, 3A, 3B and 3C, selected optical delay line paths 32 for flat arrays are created by the selective alignment of the rotor fibers 20 with selected output fibers 26. In the flat array case, there are more rotor fibers 20 than there are output fibers 26. Thus, regardless of the rotor position, only some of the rotor fibers 20 are aligned with the output fibers 26. In FIGS. 3A, 3B and 3C, the alignments of the rotor fibers 20 and the output fibers 26 are shown through various beam positions for a linear array. As can be seen in the figures, for a linear array the distribution of lengths of adjacent rotor fibers 20 is preferably parabolic. As can be seen best in FIG. 3A, the relative lengths of adjacent output fibers 26 are also parabolic. It should be recognized that although the rotor fibers 20 and output fibers 26 are represented in the figures as being straight, the fibers are preferably coiled. Coiling the rotor fibers 20 allows one to use fibers of different lengths. The lengths of the rotor fibers 20 and the output fibers 26 are designed so that when selected rotor fibers 20 are aligned with the output fibers 26, the delay paths 32 formed by the combined fiber lengths are equal, thus having a linear distribution with a slope of zero, as seen in FIG. 3A.

As the rotor 14 is rotated causing the output fibers 26 to be aligned with different rotor fibers 20, the delay paths 32 have a perfectly linear but variable distribution. Thus, in the position seen in FIG. 3B, the delay path length distribution remains linear, but now having a slope. As the rotor 14 is continued to be rotated, as represented by FIG. 3C, the output fibers 26 align with still different rotor fibers 20. Again, the length distribution in the delay paths 32 is linear but with a slope different than the slope of the distribution of delay path lengths in FIG. 3B. Thus, regardless of the position of the rotor fibers 20 with respect to the output fibers 26, a linear distribution of combined fiber lengths results. In other words, the tops of the fibers 26 of the diagrams of FIGS. 3A, 3B and 3C always form a straight line.

In each of FIGS. 3A, 3B and 3C, the amount of time delay of the signal reaching each radiating element 12 is determined by the length of the delay path 32. The longer the delay path 32, the longer the time for the signal to reach each radiating element 12. Thus, in FIG. 3A, each radiating element 12 will emit the signal at the same time, since each delay path 32 is equal in length. But in FIG. 3B, the radiating elements 12 receiving the signal from the shortest delay path 32 will emit the signal first, while those radiating elements 12 receiving the signal from the longest delay paths 32 will emit the signal last. The angle by which the beam is steered by the time delay of the optical commutator can be calculated by the slope of the length distribution of the delay line paths 32.

The rotor is caused to rotate by any convenient means such as having a motor-driven shaft (not shown) connected to it. Preferably, the electrical components of a motor (not shown) are integrated into the rotor and stator. With the optical commutator capable of being its own motor, the commutator may be sealed, evacuated reducing friction in the system and reducing the possibility of contaminating the optical surfaces. A magnetic bearing may be employed, eliminating the possibility of any wear in the elements.

The performance requirements of a radar or communication system determines the beamwidth to be attained by the antenna array. The higher the required resolution of the antenna, the narrower will be the beamwidth, and the greater will be the number of antenna elements 12. The beamwidth for a flat array (linear or planar array) is related to the number (n) of elements 12 in a row, with the spacing of one half wavelength, by the formula:

$$n=102/\Phi_b$$

whereas $\Phi_b$ is the half power beamwidth. Since each element 12 is connected to an output fiber 26, n also represents the number of output fibers 26.

As each element 12 requires a separate timing control, the value of n is also the number of output fibers 26 to be utilized in the optical commutator. A further consideration in the design of the optical commutator is the arc over which the array must scan. If this arc is defined as plus and minus $\Phi_m$ from the boresight, the number of usable positions or settings (particular alignments of the rotor fibers 20 with the output fibers 26) will be given by the formula:

$$N=2\Phi_m/\Phi_i$$

where $\Phi_i$ is the incremental indexing angle of the rotor 14. In practice, $\Phi_i$ must be at least as small as $\Phi_b$ to achieve full field coverage. Setting $\Phi_i$ equal to $\Phi_b$ gives the minimum value of N:

$$N=2\Phi_m/\Phi_b$$

The number (m) of rotor fibers 20 of the optical commutator may be calculated using this value of N and by knowing the number of output fibers n, by the following relationship:

$$m=N+n$$

Once the scanning arc and the resolution have been defined, the number of rotor fibers 20 can be established from the above equations. The number of rotor fibers 20 is directly proportional to the system angular resolution. It should be noted that in a flat antenna array, not all of the possible rotor positions can be used. As the rotor 14 is rotated and the output fibers 26 begin to align with some of the rotor fibers 26 designated as the extreme right of FIGS. 3A through 3C and some of the rotor fibers 20 designated as the extreme left of FIGS. 3A through 3C, some settings will not be usable. These settings are referred to as flyback settings. The fraction of total rotor positions that are usable is given by the formula:

$$\text{usable/total}=(m-n)/m$$

where m is the number of rotor fibers 20 and n is the number of output fibers 26.

When the rotor 14 of the optical commutator is turned, the output fibers 26 align with the successive groups of rotor fibers 20 to obtain the necessary timing to steer the flat antenna array. A feature of the parabolic distribution of lengths for the commutator fibers is that the rate of change of the delay path lengths is proportional to the rotor 14 displacement from boresight. This results in a specific relationship between the angle through which the rotor 14 turns and the angle through which the antenna is steered. This relationship is almost linear so that a given amount of rotation of the rotor 14 will result in a corresponding rotation of the microwave beam in space. The magnitude of the beam rotation in space will depend on the "gear ratio" which in turn depends on the particular design of the commutator. The gear ratio is defined as the ratio of the angular change of the rotor to the angular change in the beam steering direction. A rotor or "shaft" rotation of $\Phi_s$ will result in a beam rotation of $\Phi_b$ which is equal to $G\Phi_s$ where G is the gear ratio. The rotor fibers 20 have a parabolic distribution and are arranged with an angular pitch of P. If the total number of rotor fibers 20 is m, the angular pitch (P) in radians will be given by:

$$P=2\pi/m$$

By rotating the rotor by P, the output fibers 26 will be moved from alignment with one setting of the rotor fibers 20 to the next, which results in the transmitted beam being indexed to the next beam steering setting. The number of settings through which the transmitted beam is indexed will depend on the beamwidth and the maximum angle (plus and minus $\Phi_m$ from the boresight) over which the beam is steered. A full rotation of the rotor 14 will rotate the beam through $2\Phi_m$ and through the flyback settings. The portion of the rotor rotation taken up with the flyback settings depends on the number of rotor fibers 20 and output fibers 26 and is calculated by:

$$F=2\pi n/m$$

The usable rotation of the rotor 14 is given by:

$$R=2\pi(m-n)/m$$

The gear ratio is then found by:

$$G=R/2\Phi_m=(\pi/\Phi_m)(m-n)/m$$

Figure 4:
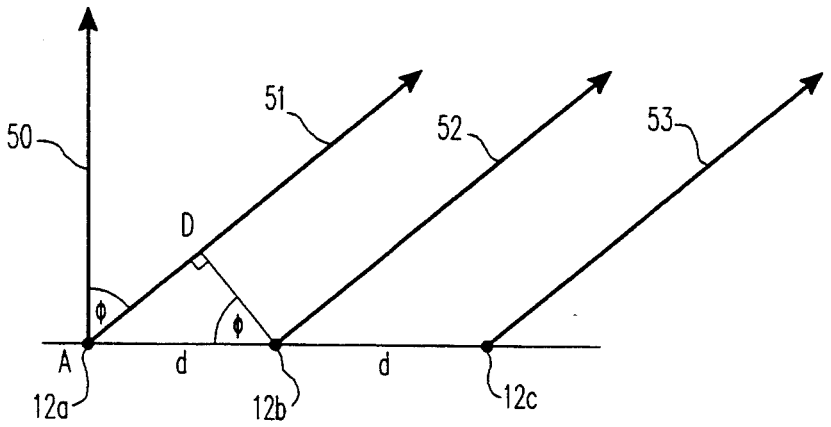
FIG. 4 is a schematic representation of the direction of beam steering from adjacent antenna elements.

Once the system requirements have established the arc over which the beam must steer and the magnitude of the angular intervals the beam is to be stepped, the lengths of the rotor fibers 20 and output fibers 26 may be calculated. FIG. 4 illustrates three antenna elements 12*a*, 12*b* and 12*c* which are equally spaced by distance d. Each element radiates a signal indicated by arrows 51, 52 and 53. If the antenna is to be steered at an angle $\Phi$ from the boresight 50, element 12*a* must emit earlier from the time it takes the radiation to travel the distance between element 12*a* and reference point D (referred to as distance AD). Distance AD is given by:

$$AD=d \sin \Phi$$

where d is the element spacing. The delay needed for element 12*b* must be more than that of element 12*a* by a time t given by:

$$t=d \sin \Phi/c$$

where c is the speed of light in free space. The speed of light is slower in the fiber optic delay lines by the factor $\mu$, the refractive index of the fiber optical material. The difference in lengths of the delay path 32 for element 12*a* and the delay path 32 for element 12*b* is given by:

$$\Delta L=d \sin \Phi/\mu$$

If the maximum angle to be steered is $\Phi_m$, the maximum fiber optic length difference $\Delta L$ will be:

$$\Delta L=d \sin \Phi_m/\mu$$

The length of a rotor fiber 20 may be expressed by the equation:

$$L_n = L_0 - an^2$$

where n is the rotor fiber position counted from the center of symmetry of the rotor winding distribution, $L_0$ is the length of the fiber in the center of symmetry position, $L_n$ is the length of the rotor fiber n positions away from the center of symmetry and a is the parabolic constant that defines the scale of the parabolic distribution of rotor fibers (determined by the system requirements). The above equation for $L_n$ may be stated, through mathematical substitutions, by the following formula:

$$L_n = L_0 - n^2(d/\mu) \sin \Phi_m/(2\,\Phi_m/\Phi_i - 1)$$

The rotor fibers 20 are wound within the rotor 14 in any convenient manner. However, each fiber optic end preferably is directed directly towards its coupled optical transmission line. Therefore, the rotor fiber second ends 24 preferably interact the rotor outer surface 16 at a 90° angle. Additionally, care must be taken so that the bending radius of any point on the rotor fiber 20 does not become too small. If the bending radius on fiber optics is too small, excessive light loss will occur.

Similarly, it can be shown that the length of the output fibers in the nth position from the center of symmetry of the output fiber distribution is given by:

$$L_n = L_s + n^2(d/\mu) \sin \Phi_m/(2\Phi_m/\Phi_i - 1)$$

where $L_s$ is the length of the output fiber 26 at the center of symmetry of the output fiber distribution.

The optical commutator may also be employed in a circular array of radiating elements 12. The principal of the commutator is the same for the circular array as for the flat array, however, different rotor fiber and output fiber distributions are used. Additionally, there are more output fibers than rotor fibers in the circular array. Therefore, regardless of the rotor position, the rotor fibers are aligned with only some of the output fibers.

Figure 5:
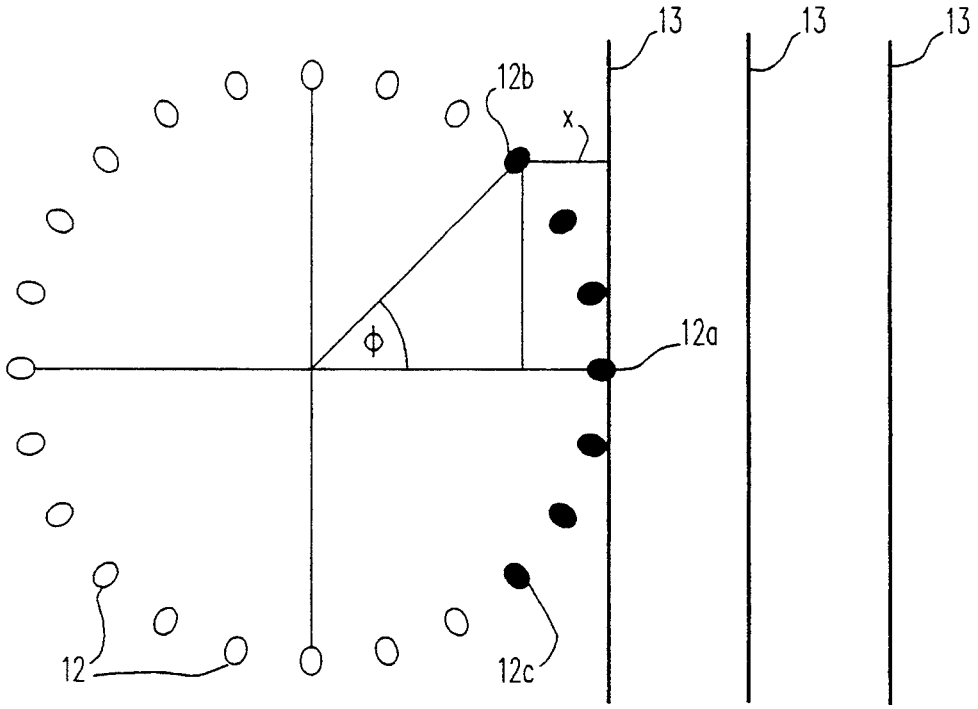
FIG. 5 is a schematic representation of a circular antenna array.
Figure 6:
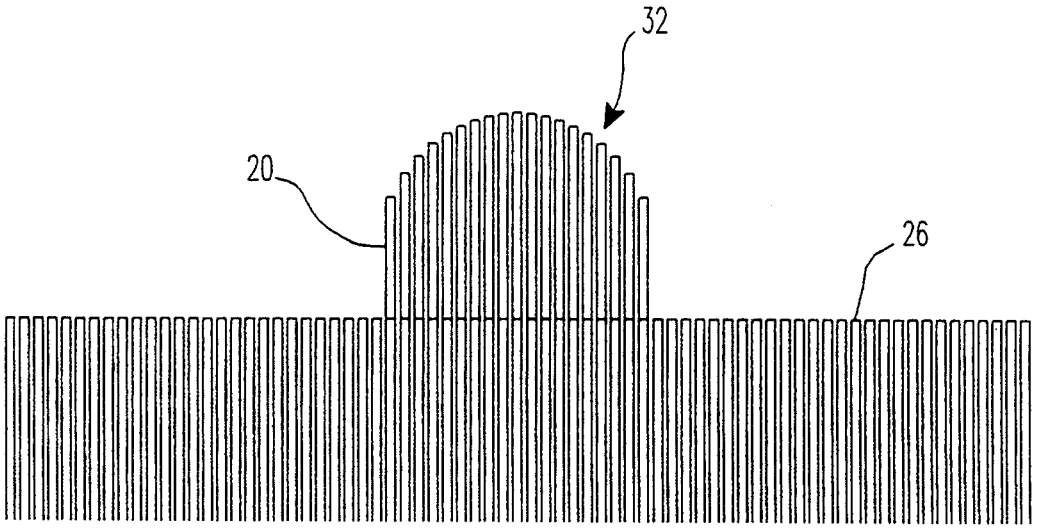
FIG. 6 is a representation of the alignment of the rotor fibers and the output fibers for a circular array.

The beam is steered in this array configuration as best seen in FIGS. 5 and 6. The radiating elements 12 are arranged in a circle and various segments of the circle are caused to be excited by the microwave signals. For the wavefronts 13 of FIG. 5 to be formed, the signal at radiating element **12*a* must be delayed a selected amount. The signal at elements 12*b* and 12*c* must be delayed a less amount. The radiating elements between element 12*a* and 12*b* and between element 12*a* and 12*c* must be delayed a progressively lesser amount from 12*a* to 12*b* and 12*c*, respectively. The delay path lengths can be seen best in FIG. 6**. The output fibers are each of the same length, and the rotor fibers have a cosine-shaped length distribution. Thus, the delay path length distribution is cosine-shaped.

The advance in time of elements **12*b* and 12*c* over the element 12*a* is the same time that it takes the radiation to travel distance x (the distance from elements 12*b* and 12*c*** to the wavefront tangent line). The time to travel distance x is given by the equation:

$$t_n = x/c = R(1 - \cos n_o\Phi)/c$$

where c is the velocity of light and $n_o$ is the element number counted from the boresight axis. To produce the wavefront 13 the nth element must lead in time by $t_n$ or the center element **12*a* must be delayed by time $t_n$ over the nth element. The length of each delay path 32 dictates the amount of time delay imparted to each radiating element 12. The optical delay line path 32 feeding the center element 12*a* must be longer than the delay line path 32** of the $n_o$ element by distance y given by:

$$y = R(1 - \cos n_o\Phi)/\mu$$

where $\mu$ is the refractive index of the fiber optic.

Figure 7:
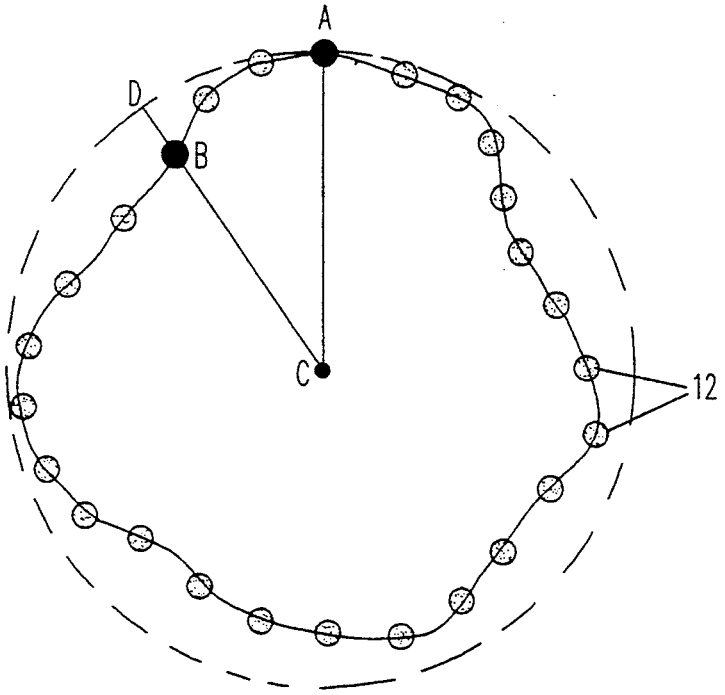
FIG. 7 is a schematic representation of an irregular antenna array.

Referring to FIG. 7 a conformal array is shown. These conformal or irregular arrays are treated as a type of circular array. The irregular array can be converted to the circular equivalent discussed above by adjusting the lengths of the output fibers. A reference circle shown in dotted line can be drawn around the conformal antenna array as shown. A point C within the circle can be selected as a reference point. From this point, the timing can be measured. Consider two transmitting elements A and B connected to point C by straight fibers. Point A is located on the reference circle and hence can be considered a reference point. The output fiber length to control this transmitting element at A will be proportional to the distance AC. Transmitting element B on the other hand is at a distance DB from the reference circle. If a signal were to be sent simultaneously to both A and B it would arrive at B first. If then the signal were to be transmitted by B, it would arrive at the reference circle before the signal had reached A. This is because the speed of light is slower in the fiber than it is in free space. For simultaneous arrival, an extra length must be added to the fiber feeding element B. This extra length is given by:

$$DB(\mu - 1)/\mu$$

Similarly, all of the other elements can be adjusted so that the conformal array is converted to the circular equivalent. Thus, the length distributions for the circular array will be employed in an irregular array with each output length being adjusted. In this manner, any odd shaped array can be converted to the circular equivalent by adjusting the output fiber lengths that feed the transmitting elements. The rotor fiber lengths will remain the same as that for the circular array case.

Figure 8:
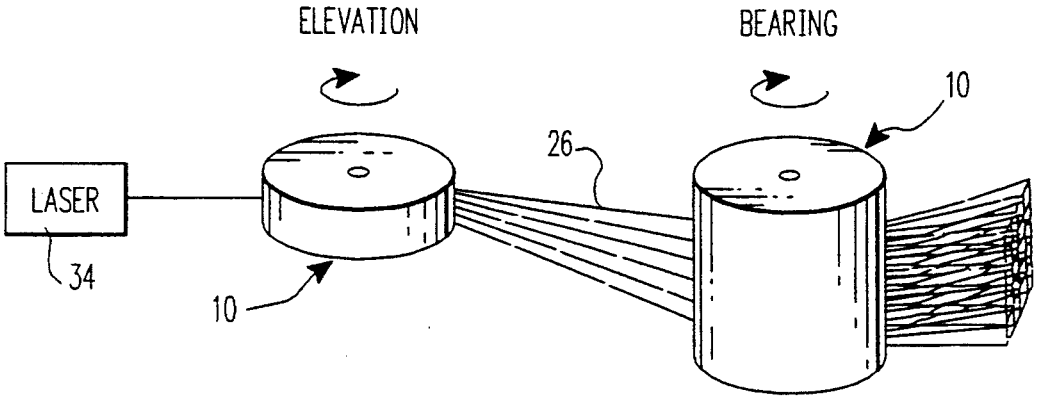
FIG. 8 is a schematic representation of two dimensional steering using two optical commutators.

Referring to FIG. 8, two dimensional steering can be accomplished by employing two optical commutators in series. One commutator provides the elevation steering and the other commutator provides the bearing steering. The first commutator provides a selected number of outputs, each of which feed the second commutator providing a selected number of outputs for each feed. Thus, a planar or cylindrical array can be constructed by utilizing a linear or circular array commutator, respectively, as one of two commutators used in series.

The rotor 14 can be caused to rotate by any convenient means but preferably has conventional and known motor components such as electrical windings incorporated on the rotor and the stator. Alternatively, the rotor may be mounted on a shaft with the shaft being coupled to a motor.

Figure 9:
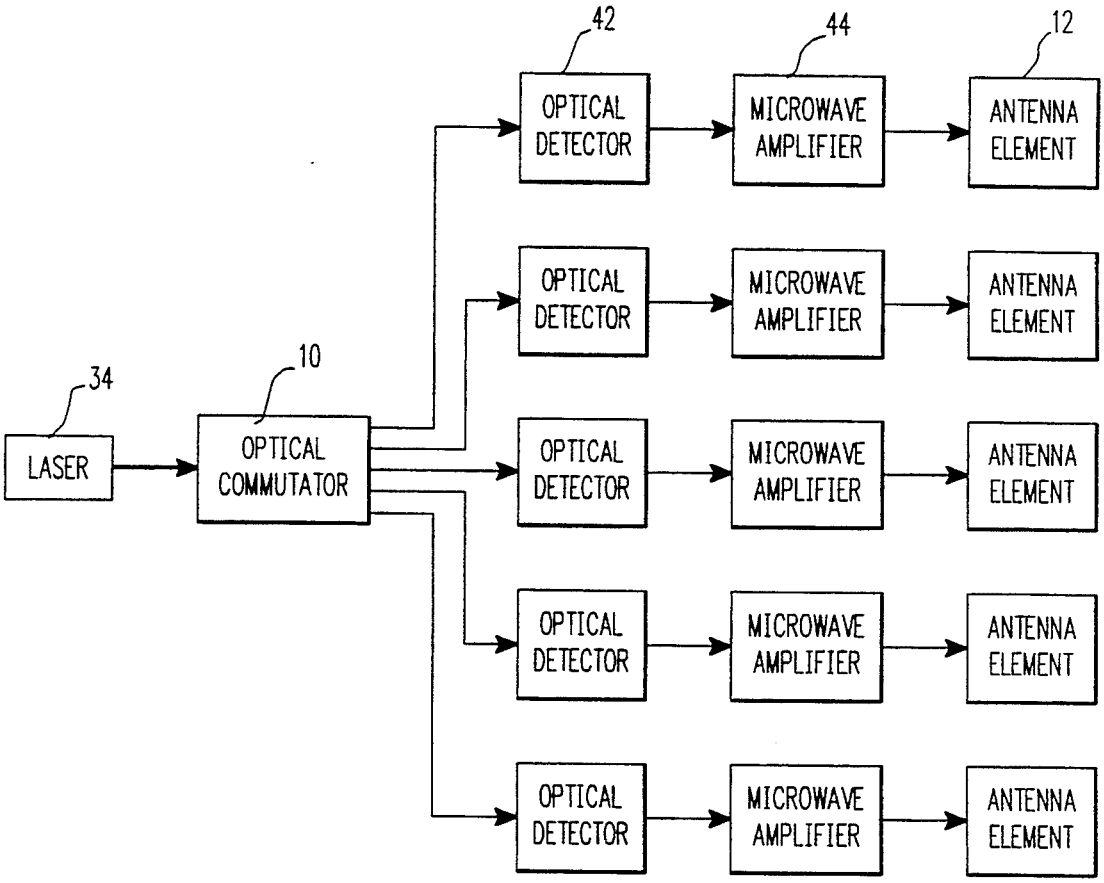
FIG. 9 is a block diagram of a transmitting array steered by the optical commutator.

Referring next to FIGS. 2 and 9, the second end 30 of the output fibers 26 are connected to an optical detector 42 in series with a microwave amplifier 44. The optical detector 42 and microwave amplifier 44 convert the optical signals to a microwave signals of sufficient magnitude to effectively transmit. Once converted to microwave, the signal is transmitted to respective radiating elements 12.

A variety of optical detectors are known in the art. Such devices are commonly fabricated from either silicon, germanium or indium-gallium arsinide. The choice of material is dictated by the wavelength of the light to be detected. Light having wavelengths in the 1300 nanometer range cannot be detected by the silicon devices because the photon quantum energy is insufficient to generate hole-electron pairs. Although several different types of optical detector devices are known, the pin diode type is the preferred optical detector type because they have a relatively high frequency capability.

Figure 10:
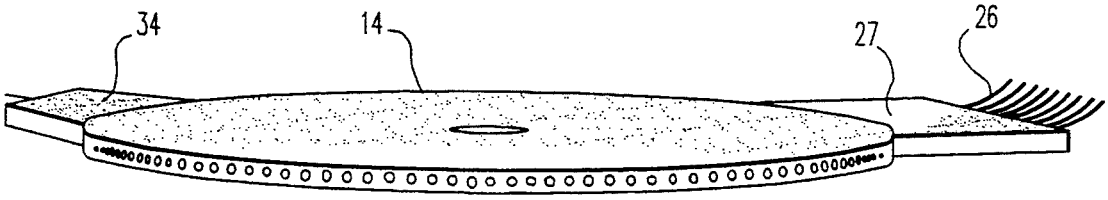
FIG. 10 is a perspective view of a second preferred optical commutator.

Referring next to FIG. 10, a second preferred embodiment of the optical commutator is shown. The optical commutator of this embodiment has a cylindrical rotor 14 having a plurality of optical fibers 20 provided therein. The rotor 14 has a cylindrical outer surface 16. Each rotor fiber 20 has a selected length. The rotor fibers 20 further have a first end 22 and a second end 24 that terminate along the outer surface 16 of the rotor 14. It is desirable for the efficient transmission of light for the first and second ends of the rotor fibers 22, 24 to align with the input source 34 and output fibers 26, respectively. The rotor fiber first and second ends 22, 24 are circumferentially spaced on the rotor outer surface 16 at a constant angle.

The optical commutator also has an input source 34 located at the rotor outer surface 16 for providing an optical input to the first end 22 of selected rotor fibers 20. The preferred input source 34 is a multifurcated beam splitter. The optical signal may thus be input to several rotor fiber first ends 22 simultaneously.

Therefore, the optical input may be input directly to the rotor fibers or, alternatively, the input may be directed through a set of intermediate optical fibers 35 (shown in dotted line in FIGS. 3A, 3B and 3C) to the rotor fibers. In the case in which a set of intermediate optical fibers 35 connect the rotor fibers to the input source, the intermediate fibers 35 are preferably all of equal length, however, intermediate fibers 35 may have a parabolic length distribution. When the intermediate fibers 35 have a parabolic length distribution, they would have a length distribution similar to what is shown for the output fibers in FIG. 3A, 3B and 3C. In this case, the intermediate fibers 35 would cooperate with rotor fibers 20 to comprise the linear delay paths 32 shown in the figures and the output fibers would preferably all be of the same length and would additionally comprise the delay paths 32.

A plurality of output optical fibers 26 are provided, each having a selected length and having a first end 28 and a second end 30. The first end 28 of the output fibers 26 are alignable with the second end 24 of selected rotor fibers 20. The second ends 30 of the output fibers 26 are connectable to respective radiating elements 12. As the rotor 14 is rotated, selected rotor fibers 20 are aligned with the output fibers 26. The output fibers 26 may be housed in a housing 27 that is circumferentially spaced at a constant radial angle from the input source 34. Or, both the output fibers 26 and input source 34 may be housed in a stator similar to the stator of the first preferred embodiment.

Aside from both the first 22 and second 24 ends of the rotor fibers 20 terminating along the outer surface 16 of the rotor 14 and having the input source 34 directed toward the rotor outer surface 16, the second preferred embodiment of the optical commutator functions identically to the first preferred embodiment. Therefore, the length distributions of the rotor fibers and the output fibers are preferably provided as discussed above for the first preferred embodiment in a flat, circular or conformal array.

To this point of the description of the second preferred embodiment, a first end 22 and a second end 24 of the rotor fibers 20 has been described. However, it is understood that optical signals may be transmitted in either direction within the rotor fibers 20. Therefore, whichever end of each rotor fiber 20 is aligned with the input source 34 is considered the rotor fiber first end 22. Similarly, whichever end of each rotor fiber 20 is aligned with an output fiber 26 is considered the rotor fiber second end 24. Thus, after a complete rotation of the rotor 14 has occurred, a given end of any rotor fiber 20 has been aligned with both the input source 34 and the output fibers 26.

Although one input source 34 and one set of output fibers 26 are shown and preferred, additional pairs of input sources and sets of output fibers may be used. These additional pairs of input sources and sets of output fibers allow more than one beam to be steered from the same antenna array using only one optical commutator.

For either embodiment, the rotor preferably indexes to a specific angle of steering, dwells, and then indexes to a new angle of steering. However, the rotor may instead rotate continuously. Also, the rotor may rotate through a given steering position, dwell, and then reverse direction of rotation so as to oscillate.

The optical input is preferably directed as a pulsed laser beam; however, the laser input may be continuous. By coordinating the frequency of the pulse with the rotation of the rotor, antenna beam steering may be accomplished. For example, if the laser is pulsed at the same rate that the rotor is rotated, the same rotor fibers will receive the optical input, and the antenna beam will be steered in a fixed direction. To steer the beam, the laser input can be pulsed at a greater or lower repetitive rate as compared with the rotational rate of the rotor. Similarly, the pulse rate of the laser may remain fixed while the rotational rate of the rotor is varied.

It should be noted that if the laser input is continuous, the dwell time, that is the time period during which the light can pass unimpeded through the commutator, will be a fraction of the time in which energy is supplied. This is because light may only be transmitted when the rotor fiber and output fiber are in at least partial alignment. Of course, the transmission of the light is most efficient when the rotor fibers and output fibers are exactly aligned.

Additionally, there are limitations as to the length of the laser pulse. If the pulse is too long, the rotor fibers and output fibers will begin to move out of alignment during the pulse and the efficiency of the transfer will be reduced. Efficiency of the light signal transfer can be increased by making the diameters of the output fibers larger than the diameters of the rotor fibers.

Figure 11:
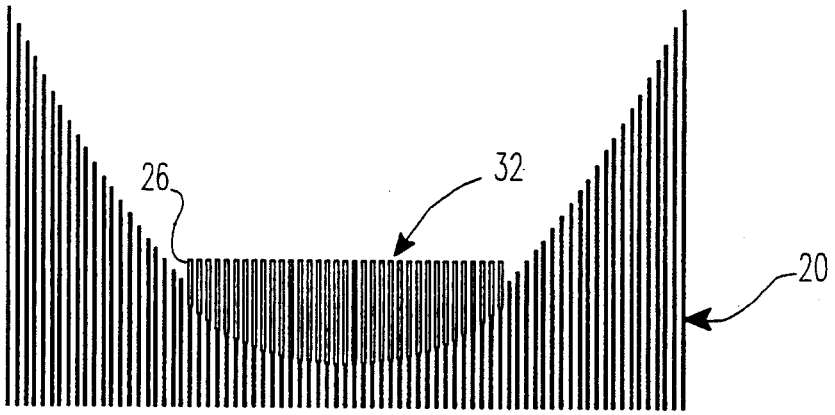
FIG. 11 is a representation of an alternative delay path configuration for the optical commutator in a linear array.

Variations of the preferred embodiments can be made. For example, the preferred length distributions of the rotor fibers and the output fibers are parabolic, with the output fibers being convex and the rotor fibers being matingly concave as seen in FIGS. 3A through 3C. However, as shown in FIG. 11, the output fibers may have a concave parabolic length distribution while the rotor fibers are matingly convex.

Also, the ends of the rotor fibers are preferably circumferentially spaced at some distance from one another along the rotor outer surface. However, the circumferential spacing between rotor fiber ends may be reduced to virtually no distance, creating an effective continuum of fiber optics.

Figure 12:
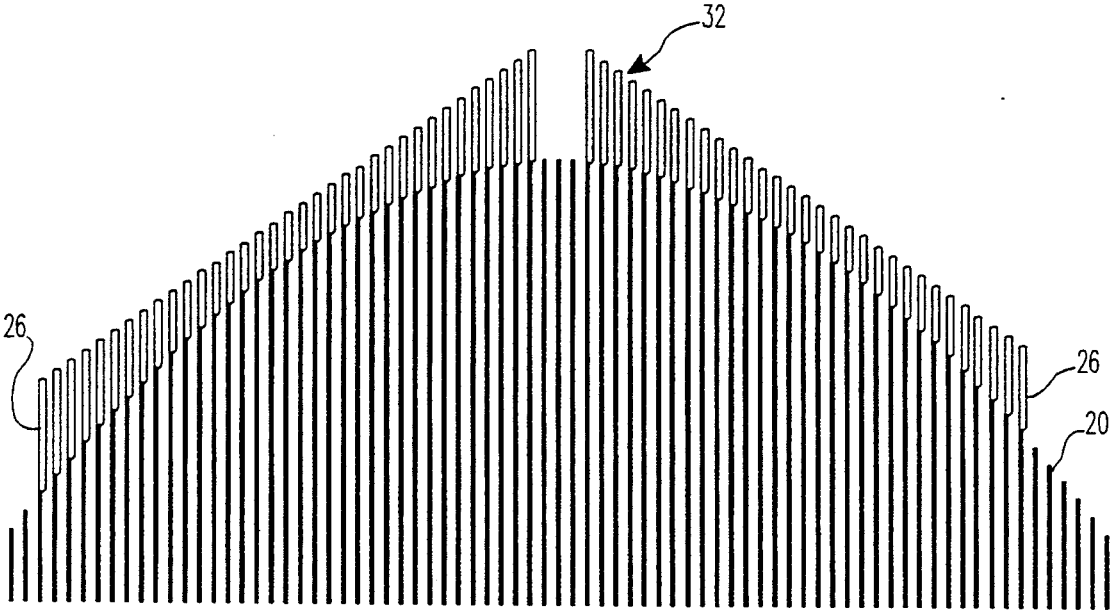
FIG. 12 is a representation of the alignment of two sets of rotor fibers with the output fibers in a linear array.

Additionally, although only one set of output fibers is utilized in the preferred embodiments, two or more sets of output fibers may be employed as shown in FIG. 12. Multiple sets of output fibers can be particularly advantageous where higher pulse repetition frequencies are desired. Furthermore, in the flat antenna array application, multiple poles can be employed to provide valid steering positions from one set of fibers while another set of fibers are on a flyback setting.

Similarly, multiple sets of rotor fibers may be employed in a single rotor. If the first and second ends of the rotor fibers do not lie at 180° from one another along the rotor periphery, as is preferred, but rather lie at some lesser angle, then more than one set of rotor fibers may be placed in the rotor.

While certain present preferred embodiments have been shown and described, it is distinctly understood that the invention is not limited thereto but may be otherwise embodied within the scope of the following claims.

I claim:

1. A device for delaying signals fed to radiating elements of an array antenna, the device providing delay paths of selectable length between the respective radiating elements and signal generating means, the device comprising:

(a) a set of first fiber optic lines, each first fiber optic line having a first end, a second end and a selected length wherein selected first fiber optic line first ends receive signals from the signal generating means;

(b) a set of second fiber optic lines, each second fiber optic line having a first end, a second end and a selected length and wherein the first ends of selected second fiber optic lines are alignable with the second ends of selected first fiber optic lines and wherein the second fiber optic line second ends are connected to respective radiating elements through optical to microwave signal converting means; and (c) means for moving at least one of the first and second sets of optical fibers relative to the other of the first and second sets of fibers, wherein delay paths are formed comprised of respective aligned first and second optical lines.

2. A device for delaying signals fed to radiating elements of an array antenna, comprising:

(a) a movable element having a plurality of optical fibers provided therein, each movable element fiber having a selected length and having a first end and a second end, each movable element fiber passing through a point on an outer surface of the movable element;

(b) a plurality of output optical fibers, each output fiber having a selected length, a first end of each output fiber being alignable with the second end of the selected movable element fibers, and a second end of the output fibers being connectable by optical detectors to respective radiating elements, the aligned movable element fibers and output fibers forming delay paths to respective radiating elements;

(c) an input source connectable to the movable element fiber first ends for providing an optical input to the first end of selected movable element fibers; and (d) means for moving the movable element so that selected movable element fibers are aligned with the output fibers providing selected delay path length distributions.

3. The device of claim 2 wherein the movable element is configured as a cylindrical rotor, wherein the optical fibers of the rotor pass through a point on an outer circumferential surface of the rotor, and wherein the means for moving the rotor cause the rotor to be rotated.

4. The device of claim 2, wherein the radiating elements are arranged in a linear array.

5. The device of claim 4, wherein the rotor fibers and output fibers have a parabolic length distribution, such that the delay paths have a linear length distribution, the linear delay path length distribution having a slope that varies with rotation of the rotor.

6. The device of claim 2, further comprising a set of intermediate optical fibers, each intermediate fiber having a selected length and being connected at one end to the input source and being connected at an opposite end to selected movable element fiber first ends, wherein the aligned intermediate fibers, movable element fibers and output fibers form respective delay paths.

7. The device of claim 6, wherein the moveable element fibers and one of the set of intermediate fibers and the set of output fibers have a parabolic length distribution, such that the delay paths have a linear length distribution, the linear delay path length distribution having a slope that varies with movement of the movable element.

8. The device of claim 2, wherein the input source is a laser.

9. The device of claim 3, wherein the radiating elements are arranged in a circular array.

10. The device of claim 9, wherein the output fibers have a linear length distribution and the rotor fibers have a cosine-shaped length distribution, such that the delay paths have a cosine-shaped length distribution.

11. The device of claim 3, wherein the rotor has a cylindrical outer surface, the rotor fiber first ends and the rotor fiber second ends terminating along the outer surface of the rotor such that the fiber ends are circumferentially spaced on the rotor outer surface.

12. The device of claim 11, further comprising a stator that is coaxial to and surrounds the rotor, wherein at least one of the input source and output fibers are housed in the stator.

13. The device of claim 11, further comprising at least one additional input source and one additional set of output fibers, each being alignable with the rotor fibers.

14. The device of claim 11, wherein the input source is located adjacent to the outer surface of the rotor.

15. The device of claim 3, wherein the rotor has an outer cylindrical surface, the rotor fiber first ends terminating at a center area of the rotor, each rotor fiber second end terminating along the periphery of the rotor outer surface such that the rotor fiber second ends are circumferentially spaced on the outer surface periphery.

16. The device of claim 15, wherein the input source is positioned so as to direct optical input toward the center area of the rotor.

17. The device of claim 15, wherein the rotor further has an inner cylindrical surface coaxial to the outer cylindrical surface, the inner surface bordering and defining a cylindrical cavity.

18. The device of claim 15, wherein the output fibers are housed in a stator having a cylindrical inner surface that borders and defines a cylindrical cavity, wherein the rotor is disposed coaxially within the stator cavity, and the output fiber first ends terminating circumferentially along the periphery of the stator inner surface.

19. The device of claim 3, wherein the radiating elements are arranged in an irregular array.

20. A method of selectively delaying signals fed from a signal generating means to respective antenna elements of a planar array, comprising the steps of:

(a) providing a set of first optical fibers, each first fiber having a selected length and having a first end and a second end, wherein the first ends of a selected number of first fibers receiving signals from the signal generating means;

(b) providing a set of second optical fibers, each second optical fiber having a selected length and having a first end and a second end, wherein the first ends of a selected number of second fibers are selectively alignable with and receiving optical signals from respective second ends of the first fibers, and wherein the second ends of the second fibers are connected to respective antenna elements; and (c) moving at least one of the set of first fibers and set of second fibers so that selected first and second fibers are aligned.

* * * * *